US006671920B2

(12) United States Patent
Pearlman et al.

(10) Patent No.: US 6,671,920 B2
(45) Date of Patent: Jan. 6, 2004

(54) POP-OUT TOOTHBRUSH AND ENCLOSURE THEREFORE

(76) Inventors: Jay C. Pearlman, 589 Rutland Dr., Highland Hts., OH (US) 44143; Douglas R. Russell, 2502 Woodside Dr., Louisville, KY (US) 40207

( * ) Notice: Subject to any disclaimer, the term of this patent is extended or adjusted under 35 U.S.C. 154(b) by 394 days.

(21) Appl. No.: 09/769,063

(22) Filed: Jan. 24, 2001

(65) Prior Publication Data

US 2001/0045369 A1 Nov. 29, 2001

Related U.S. Application Data

(60) Provisional application No. 60/263,289, filed on Jan. 22, 2001, and provisional application No. 60/178,040, filed on Jan. 24, 2000.

(51) Int. Cl.[7] ..... A46B 17/00

(52) U.S. Cl. ..... 15/184; 15/167.1; 206/362.2; 132/308; 132/311

(58) Field of Search ..... 15/184, 167.1, 15/144.4; 206/362.2, 362.3; 132/308, 311

(56) References Cited

U.S. PATENT DOCUMENTS

| | | | | | |
|---|---|---|---|---|---|
| 380,080 | A | * | 3/1888 | Bouton et al. | 15/184 |
| 1,749,565 | A | * | 3/1930 | Coryell | 15/184 |
| 1,771,645 | A | * | 7/1930 | Marsh | 206/362.3 |
| 1,801,464 | A | * | 4/1931 | Ament | 15/184 |
| 2,236,240 | A | | 3/1941 | Lowen | 15/184 |
| 2,443,361 | A | | 6/1948 | Satz et al. | 401/59 |
| 2,513,830 | A | | 7/1950 | Voegeli | 401/59 |
| 2,610,732 | A | | 9/1952 | Calhoun | 206/385 |
| 2,637,869 | A | | 5/1953 | Tomlinson | 15/184 |
| 2,828,504 | A | | 4/1958 | Nugent | 15/184 |
| 3,612,072 | A | | 10/1971 | Fukui | 206/385 |
| 4,561,854 | A | | 12/1985 | Amici et al. | 446/304 |
| 5,170,904 | A | | 12/1992 | Neuhaus | 220/262 |
| 5,187,829 | A | | 2/1993 | Atkins | 15/167.1 |
| D337,202 | S | | 7/1993 | Haddad | D4/107 |
| 5,353,464 | A | | 10/1994 | Atkins et al. | 15/167.1 |
| D363,166 | S | | 10/1995 | Perrine | D4/107 |
| 5,531,318 | A | | 7/1996 | Coleman et al. | 206/385 |
| 5,590,436 | A | | 1/1997 | Wright et al. | 15/167.1 |
| 5,699,574 | A | | 12/1997 | Oviatt | 15/210.1 |
| 5,774,921 | A | | 7/1998 | Harrison et al. | 15/167.1 |
| D402,119 | S | | 12/1998 | Landauer | D4/107 |

* cited by examiner

*Primary Examiner*—Theresa T. Snider
(74) *Attorney, Agent, or Firm*—Calfee Halter & Griswold LLP

(57) ABSTRACT

A pop-out toothbrush having a toothbrush that is movable between (i) a retracted position in which the toothbrush bristle head and toothbrush handle are substantially enclosed within a housing and one or more cover portions and (ii) an extracted or extended position in which the toothbrush bristle head and toothbrush handle extend out of the housing to facilitate practical use by a user.

36 Claims, 10 Drawing Sheets

POP-OUT TOOTHBRUSH AND ENCLOSURE THEREFORE

This application claims priority from U.S. Provisional Application Ser. No. 60/178,040, filed Jan. 24, 2000, and entitled A POP-OUT TOOTHBRUSH AND ENCLOSURE TITEREFOR. This application also claims priority from U.S. Provisional Application Ser. No. 60/263,289, filed Jan. 22, 2001, entitled POP-OUT TOOTHBRUSH AND ENCLOSURE THEREFOR.

BACKGROUND OF THE INVENTION

The present invention pertains to a toothbrush and housing for the toothbrush when not in use and, more particularly, to a toothbrush that is movable between retracted position when the toothbrush bristle head and handle are fully enclosed within the housing and a fully extracted position in which the handle extends the bristle head to facilitate practical use by a user.

The prior art depicts many applicators which house items that can be extended for use and then retracted when not in use. For example, some early demonstrations of such applicators may be found in the cosmetic arts such as lipstick holders. U.S. Pat. Nos. 2,443,361 and 2,513,830 disclose applicators where the holder of the lip stick is pushed or rotated manually so as to move the holder and its contents upward through a pair of hemisphere-shaped doors that pivot open. Similarly, U.S. Pat. No. 5,531,318 illustrates a housing for a stick of candy that can be pushed upward from within a housing through a pair of pivoting doors so that the candy can be consumed as desired by one gripping the housing. Movement of the internal housing secured to one end of the candy stick causes the doors to open and close.

It occurred to applicants that the principle of having a toothbrush device in which the toothbrush is entirely enclosed when not in use was environmentally a sound concept. Moreover, applicants were aware that such a toothbrush should be ready for quick use when desired as rummaging through drawers to find the toothbrush was not a desirable attribute. Thus, melding the aforementioned applicators was considered to be an attractive approach for use with a toothbrush. Additionally, the housing could be designed in such a manner as to appeal to children and to encourage good dental hygiene habits. Applicant, however, noted that, while all of the applicators perform as desired for the contents of the applicators, none would perform satisfactorily when coupled with the use of a toothbrush. In one of the embodiments, it is imperative that the doors pivot open sufficiently wide to permit the user to manipulate the toothbrush Typical prior art constructions show the doors retracting only to the extent of the tip of the contents, e.g., a candy stick, are exposed. According to one aspect of another embodiment, the cover portions preferably open sufficiently wide to allow the toothbrush to extend and thereafter the cover portions close on the toothbrush handle. According to another aspect of this second embodiment, the cover portions preferably open responsive to interaction with one or more control surfaces so that they open without having to be forced open by the head or bristles of the toothbrush.

BRIEF DESCRIPTION OF THE DRAWINGS

In the accompanying drawings, which are incorporated in and constitute a part of this specification, embodiments of the invention are illustrated. These drawings, together with the general description of the invention given above and the detailed description given below, serve to example the principles of this invention.

DESCRIPTION

Figure 1:
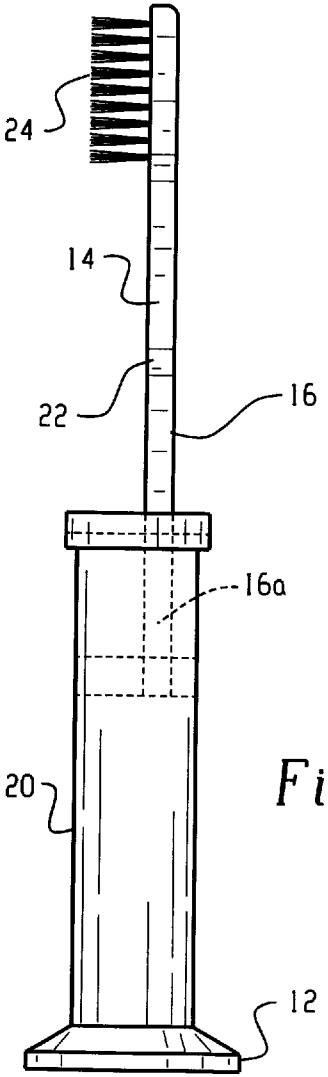
Figure 5:
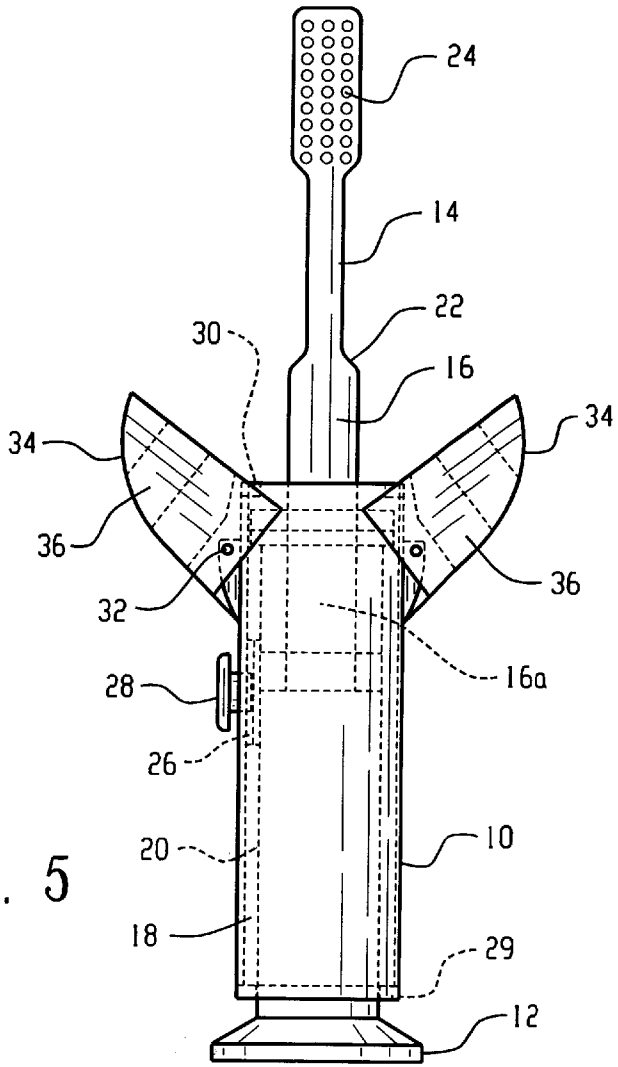

Referring now to the figures, FIGS. 1–5 show a first embodiment of the present invention. FIG. 1 shows a substantially cylindrical housing 10 that has a pedestal 12 which permits the housing to standup right on a counter top of a typical bathroom. A toothbrush 14 is shown in an extended position in which the lower distal end of the handle 16 extends into a cavity 18 defined by the housing 10. As illustrated, handle 16 is secured to a guide tube 20 that slidably engages the interior surface of housing 10. FIG. 5 shows the guide tube 20 assembled in the housing 10. Preferably, toothbrush 14 has a shoulder 22 that is approximately ⅔rds the distance from the lower distal end 16*a* to the bristle head 24. The shoulder 22 may be formed from the divergence of the handle body from a smaller cross-sectional area connected to the head 24 to a larger cross-sectional area of the portion of the handle connected to the guide 20. The function of shoulder 22 is described below.

Figure 4:
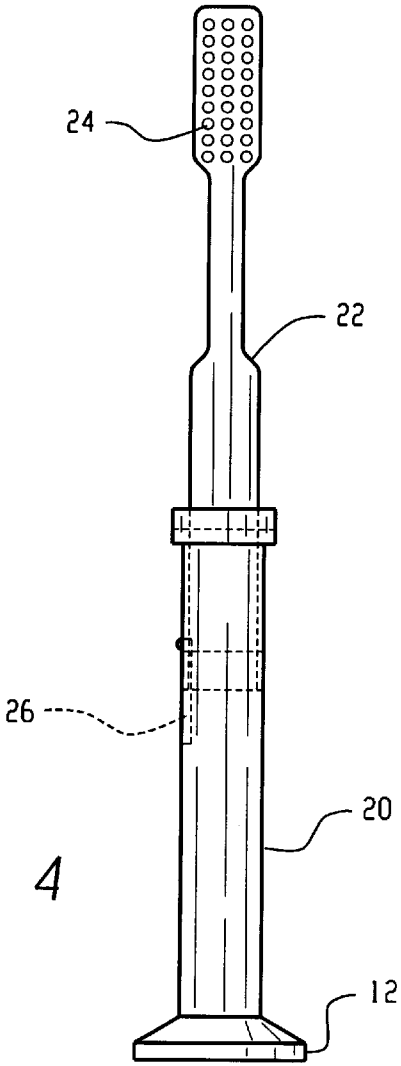

Movement of the toothbrush 14 within the housing 10 can be accomplished in a number of ways. One technique is to provide handle 16 with a button extension that rides in a channel in the wall of the housing 10. The toothbrush then may be manually pushed from a retracted position to an extended position. It is important that some structure be utilized that locks the handle 16 to the housing 10 once the toothbrush 14 is in its extended position for use. One structure that is effective is the use of a spring locking lever 26 as seen in FIGS. 4 and 5 that is mounted on the guide tube 20. Lever 26 rides against the housing 10 until it reaches a detent in the housing that registers with the fully extended position of the handle 16. At that point the lever end snaps into the detent, providing a secure locking of the handle 16 to the housing 10 while the brush 24 is being used. The lever 26 can be pushed out of the detent by use of a release button 28 located on the housing 10 that can be manually pressed against the end of the lever 26 located in the detent thus releasing the guide tube 20 and thus handle 16.

Figure 2:
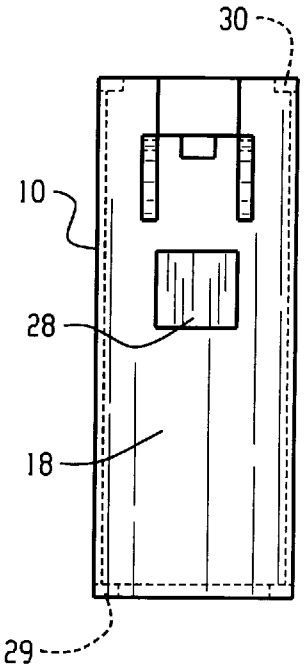

As perhaps best seen in FIG. 2, the internal wall of the housing 10 has a flange or stop 29 near the bottom that prevents the tube 20 from reaching the end of the housing 10. As a precaution the upper end of the housing has a similar flange 30 or area of reduced diameter to prevent the guide tube 10 from exiting the housing altogether should the locking lever be overridden. The upper end of housing 10 has a pair of hinge and spring assemblies 32 each of which mount a clam shell 34. The covers 34 are normally spring biased into a closed position by the springs of assemblies 32 and are provided with contour webs 36 that first abut the toothbrush head as tube 20 is manually pushed upward. Shoulders 22 next abut the webs 36 so that the covers 34 occupy the open position shown in FIG. 3. Alternatively, when employed with a toothbrush of a slim design without the shoulders, the web design is such that the abutment by the toothbrush head is sufficient to move the covers 34 to the open position. In this position, covers 34 are cammed beyond the biasing point so that, in effect, the covers 34 are now biased to remain in the open position. Once the toothbrush is pushed back into the housing, the covers 34 can be manually closed to snap back into the closed position. It should be noted that handle 16 extends sufficiently out of the housing 10 and the covers 34 are fully retracted into an open position so that when the extracted toothbrush is locked into its extended position, the user avoids all contact with the covers when brushing teeth.

In FIGS. 6–20, a second embodiment 100 of the present invention is shown. Generally, in this second, preferred embodiment of the present invention, the clamshell halves preferably open as the toothbrush is extended therethrough, close on the lower distal end of the toothbrush handle, and remain closed while the toothbrush is being used. In the alternative, the cover portions can be made to stay open during brushing, as with the first embodiment.

Figure 6:
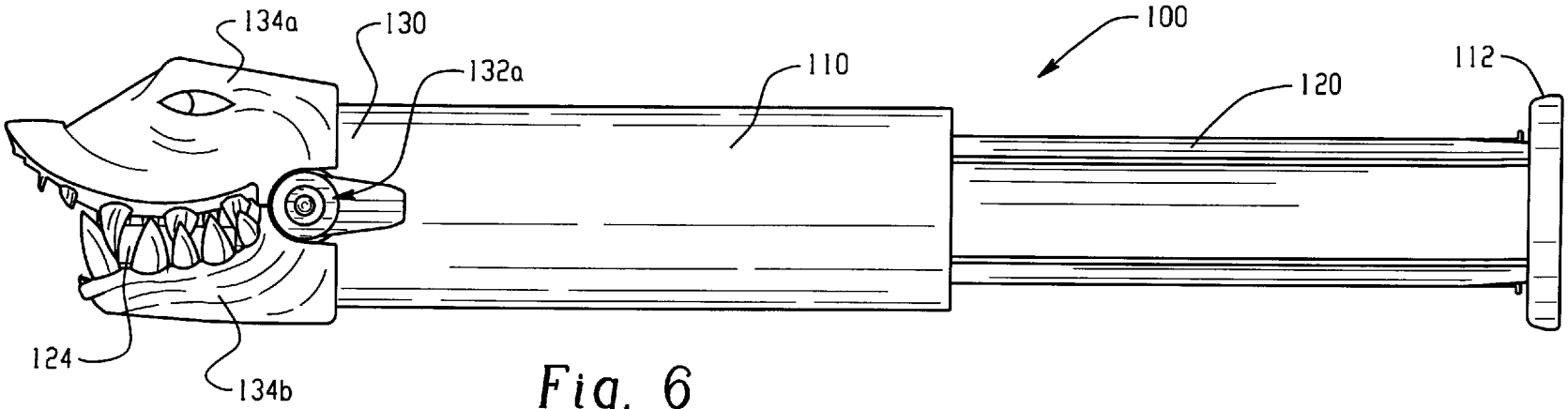
FIGS. 6–20 show a second embodiment of the present invention.
Figure 7:
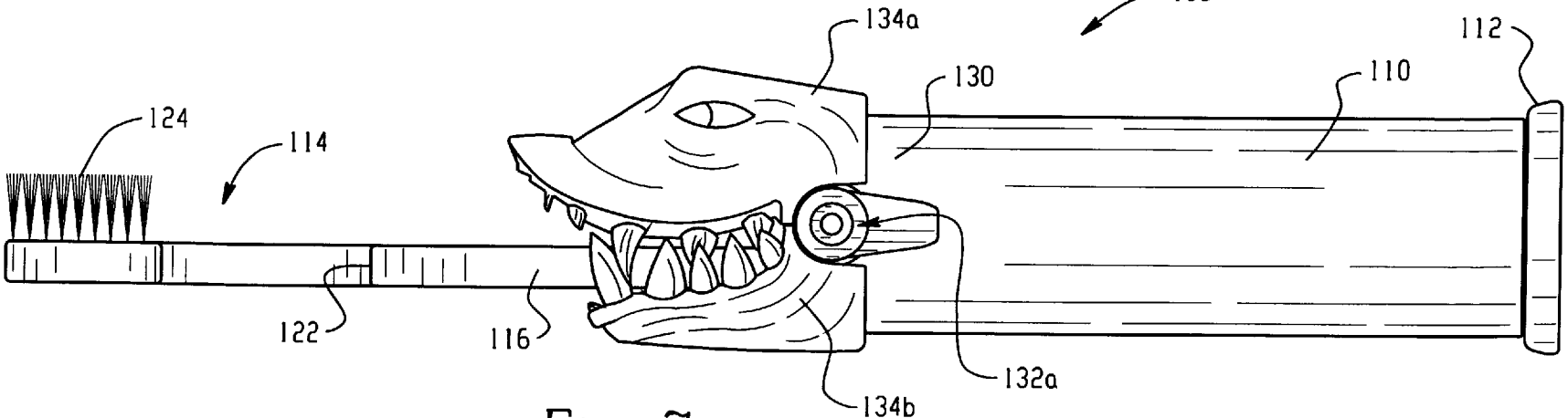
Figure 8:
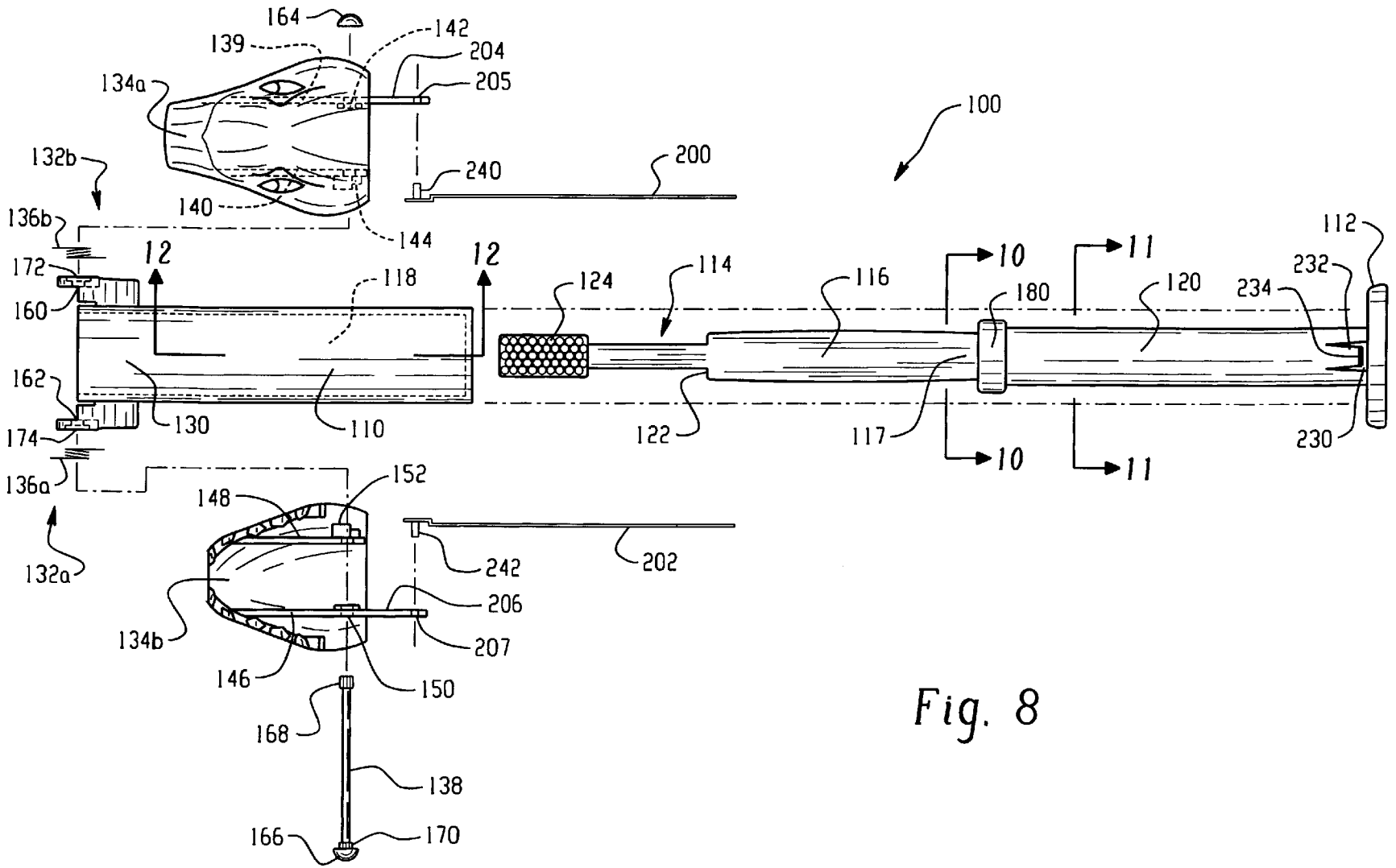

Referring more particularly now to the Figures, FIG. 6 shows the second embodiment 100 of the present invention in the retracted position and FIG. 7 shows the second embodiment 100 in the extracted or extended position. FIG. 8 shows the second embodiment 100 in an exploded, unassembled view. Like the first embodiment, the second embodiment 100 comprises a housing 110 and a pedestal 112, which pedestal 112 permits the second embodiment 100 to stand upright. The second embodiment 100 has a toothbrush 114, having a handle 116, which generally extends into and retracts out of the housing 110. More specifically, in the refracted position (FIG. 6) a majority of the toothbrush handle 116, and the lower distal end 117 of that handle 116, extend into a cavity 118 defined by the housing 110. As illustrated, in the second embodiment 100, the lower distal end 117 of handle 116 is secured to a guide tube 120 that slidably engages the housing 110, as explained below. As with the first embodiment of the present invention shown in FIGS. 1–5, the toothbrush 114 of the second embodiment 100 preferably has a shoulder 122 that is approximately two-thirds the distance from the lower distal end 117 of handle 116 to a bristle head 124. The shoulder 122 may be formed from the divergence of the handle body from a smaller cross-sectional area connected to the head 124 to a larger cross-sectional area of the portion of the handle connected to the guide 120.

As discussed above, the present invention preferably includes some form of cover for the bristle head 124 of toothbrush 114. This cover is preferably implemented with at least one movable cover. More preferably, the at least one movable cover comprises one or more movable cover portions, that cooperate to cover a substantial portion of the bristle head 124 and that can be moved in one or more directions sufficient to allow the bristle head and a portion of the toothbrush handle 116 extend from the retracted position. Most preferably, the at least one movable cover comprises one or more hinged cover portions, that cooperate to cover a substantial portion of the bristle head 124 and that can be moved in one or more directions sufficient to allow the bristle head 124 and a portion of the toothbrush handle 116 to extend from the retracted position. The hinges can be implemented in any of a number of ways, e.g., by using separate hinge portions connected with a hinge pin, by using portions of relatively flexible material (flexible enough to allow the one or more cover portions to move), etc. The hinged cover portions can be biased and/or moved into a closed or covering (e.g., more closed than open) position in any of a number of ways, e.g., with springs, manually by the user, by relying on the elastic nature of a flexible material forming a hinge, etc.

More specifically to the second embodiment 100 of the present invention, as shown in FIGS. 6–8 and 12–17, the upper end 130 of housing 110 has a pair of hinge and spring assemblies 132*a*, 132*b* each of which mount a cover portion 134 (134*a*, 134*b*). Although the covers 134*a*, 134*b* are shown in the figures as being a mandible portion and head (maxillary) portion of a parody of an animal, the covers 134*a*, 134*b* may take other forms, such as the plain, symmetrical clam shell covers 34 shown in FIGS. 3 and 5. Virtually any ornamental expression can be used to decorate the cover portions 134*a*, 134*b*. The covers 134*a* 134*b* are preferably normally spring biased into a closed position by springs 136*a*, 136*b* of assemblies 132*a*, 132*b*. Cover portions 134*a*, 134*b* each preferably have a pair of aligned openings through which a pin 138 extends, thereby forming a hinge with respect to each other and with respect to housing 110. More specifically, as shown in FIG. 8, cover 134*a* has a pair of substantially planar supports 139, 140 having holes 142, 144 therein. Similarly, cover 134*b* has a pair of substantially planar supports 146, 148 having holes 150, 152 therein. Also, housing 110 has a pair of holes 160, 162 therethrough. Pin 138 extends through hole 160, then hole 152, then hole 142, then hole 150, then hole 144, then hole 162, causing covers 134*a*, 134*b* to be hinged with respect to each other and with respect to housing 110. The pin 138 also passes through springs 136*a*, 136*b*. Knurling at each end 168, 170 of pin 138 allow the pin 138 to be press-fit into the holes 160, 162 in the housing 110, thereby securing the pin 138 into the holes 160, 162. Additionally, pin 138 preferably has end caps 164, 166, which are press-fit and preferably ultrasonically welded to the housing 110 at each end of the pin 138 to decoratively conceal pin 138 and to further keep the pin 138 in place in the housing. Housing 110 preferably includes recesses 172, 174 which accept end caps 164, 166.

Figure 11:
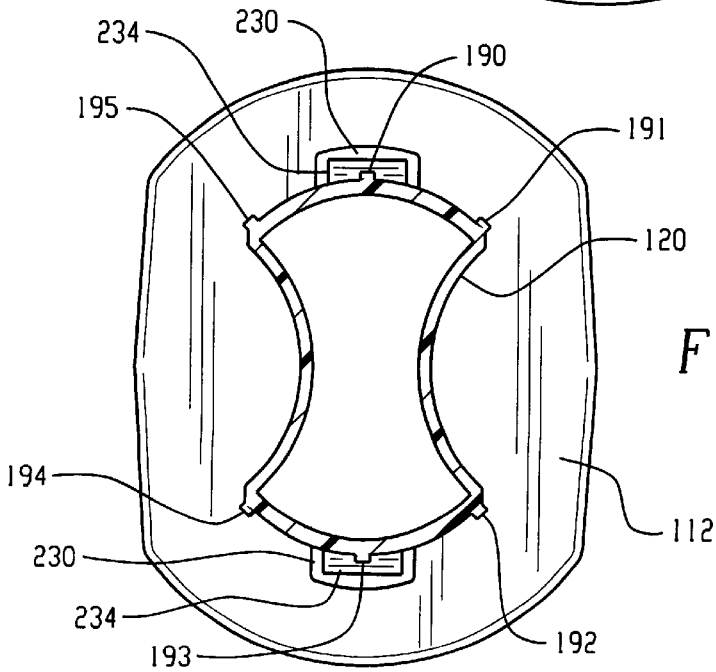
Figure 12:
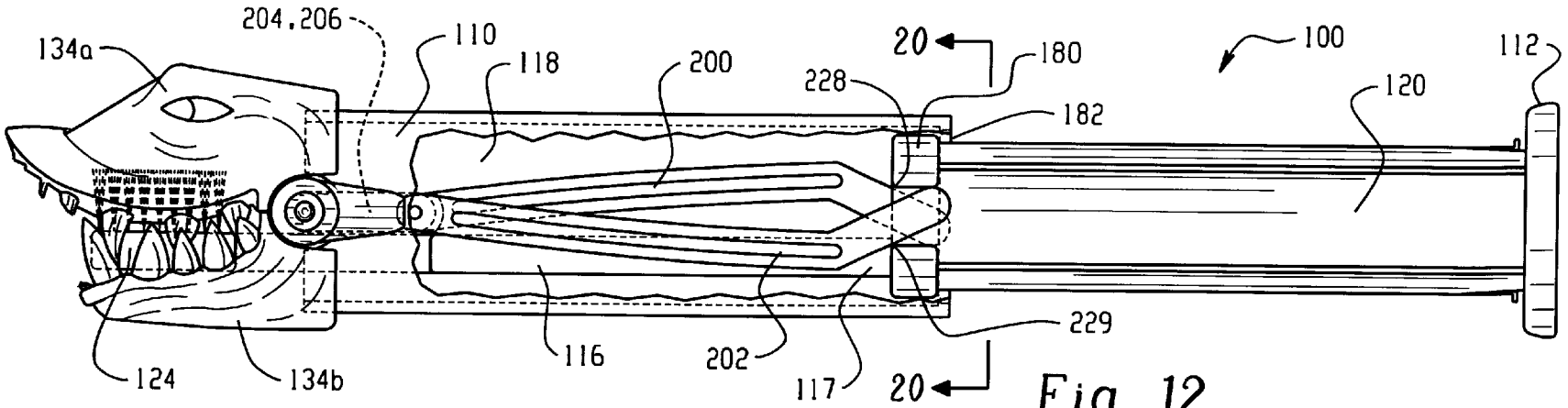
Figure 15:
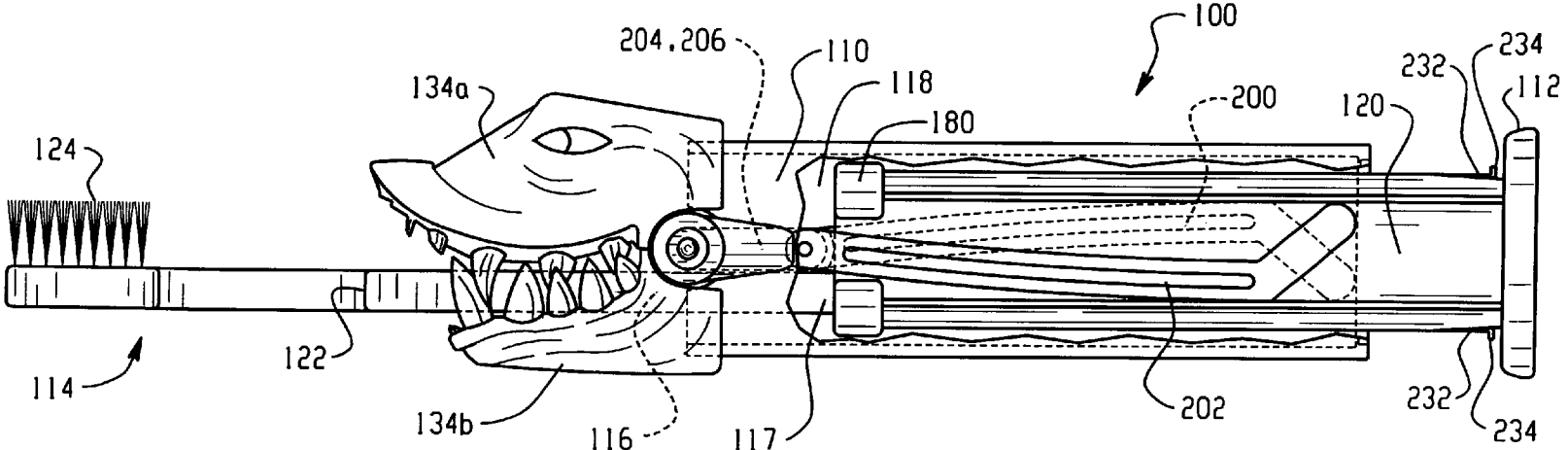
Figure 16:
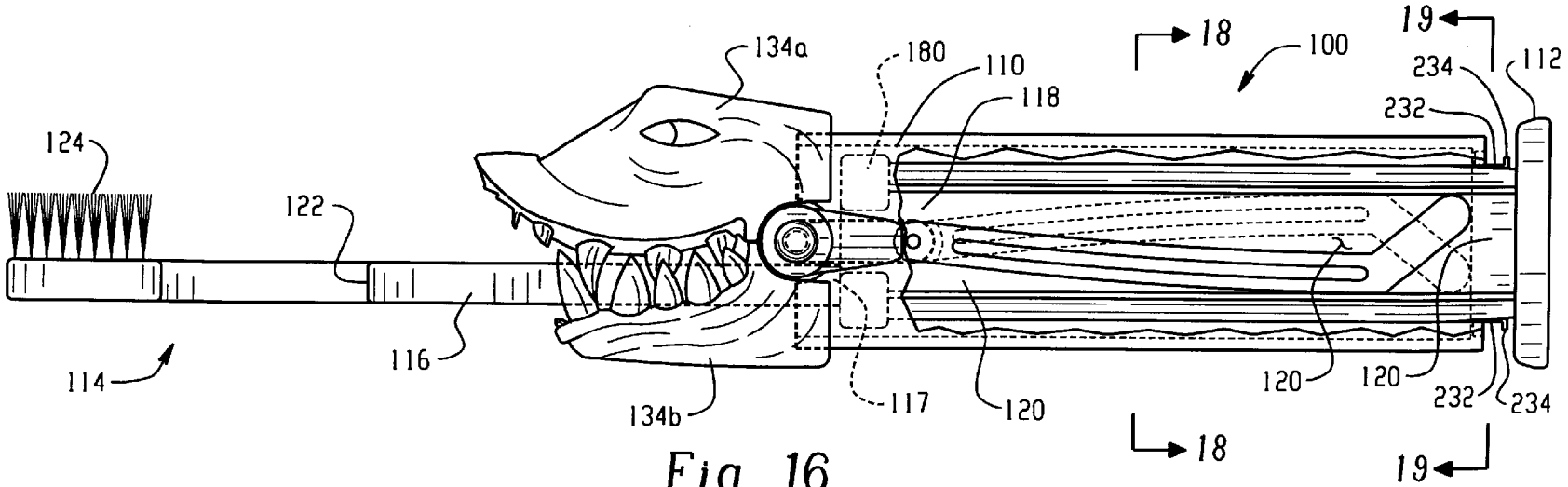
Figure 17:
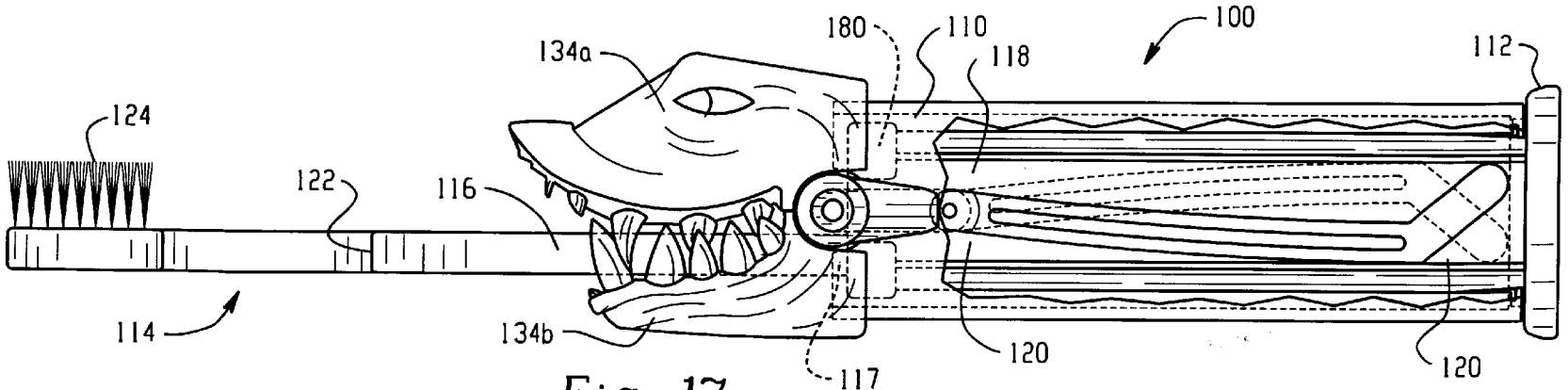
Figure 18:
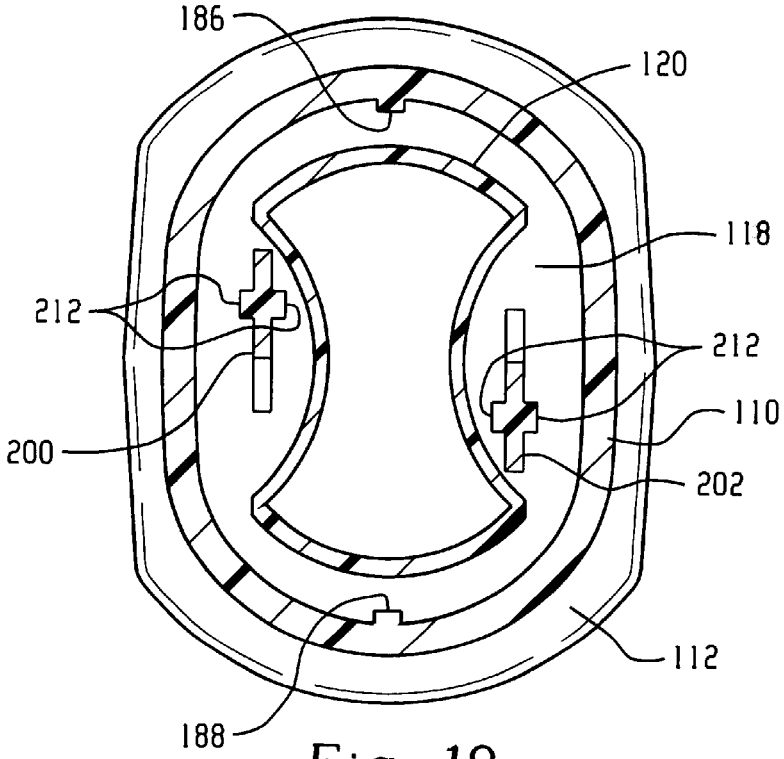
Figure 19:
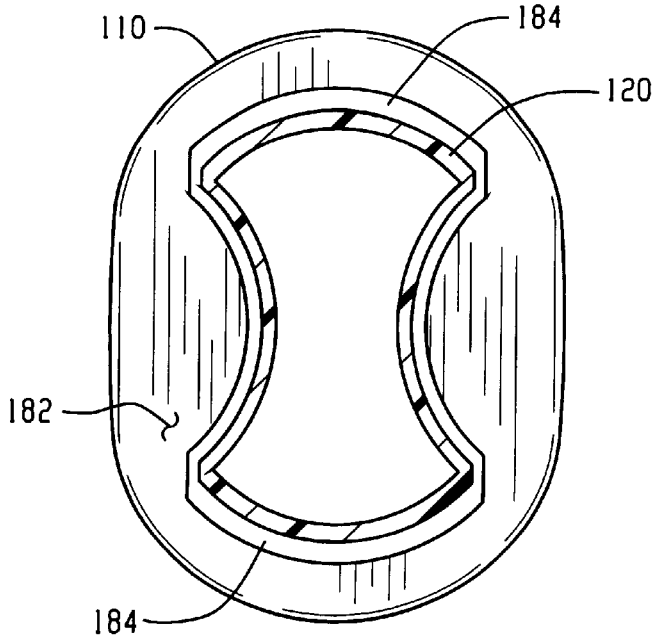
Figure 20:
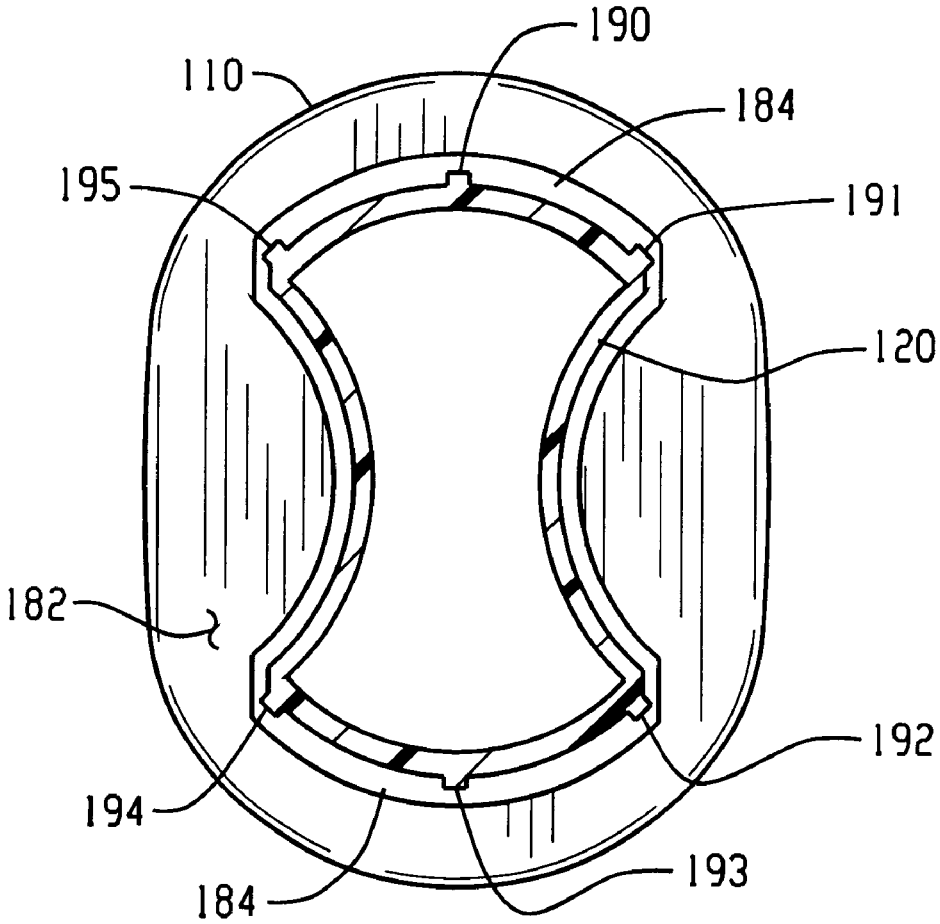

The guide tube 120 is preferably hollow, preferably having a substantially uniform cross section along its length, substantially as shown in FIGS. 11, 18, and 19. The pedestal 112 is preferably integral with the guide tube 120 at one end of the guide tube 120. The pedestal is preferably open so that the hollow inside the guide tube 120 is exposed. In this sense, the pedestal can be considered to be preferably a flared end of the hollow guide tube 120. In addition, the guide tube 120 preferably has an associated integral stop 180 at its other end. As shown in FIGS. 12–17, the stop 180 is positioned in the cavity 118 inside the housing 110. The outer cross sectional contour of the stop 180 is preferably substantially the same shape as, but a little smaller than, the inside cross-sectional contour of the housing 110. As best seen in FIG. 19, the housing 110 has an end cap 182 at the end of the housing 110 facing the pedestal 112. As shown in that figure, the end cap 182 has an opening 184 that is preferably substantially the same shape as, but a little larger than, the cross-sectional shape of the guide tube 120. The guide tube 120 extends through the opening 184. As seen in FIG. 12, the stop 180 acts as a stop against the end cap 182 of housing 110 in the retracted position, preventing the guide tube 120 from being pulled any further from the housing 110. Similarly, as seen in FIG. 17, the pedestal 112 acts as a stop against the end cap 182 of housing 110 in the extended position, preventing the guide tube from being pushed any further into the housing 110.

As shown in FIGS. 12–17 the opening 184 generally acts as a guide for the guide tube 120 as the user slides the guide tube 120 back and forth inside the opening 184. Similarly, the housing 110 generally acts as a guide for the stop 180 as the user slides the guide tube 120 back and forth inside the opening 184. These guiding functions are facilitated by very small parallel, tapering ribs on the outside surface of the guide tube 120 and on the inside surface of the housing 110. More specifically, referring to FIG. 18, the inside surface of the housing 110 carries two very small, parallel, tapering ribs 186, 188 that are tallest at the end of the housing 110 to which the covers attach and taper down to virtually no height before the end of the housing 110 at end cap 182. These ribs 186, 188 cause the housing 110 to tend to center and limit the lateral range of motion of the stop 180 (and therefore, guide tube 120) more when the pop-out toothbrush is in the extended position of FIG. 17 than in the retracted position of FIG. 12. Similarly, referring to FIGS. 11 and 20, the guide tube 120 is shown as having six very small, parallel, tapering ribs 190–195 that are tallest at the end of the guide tube 120 to which the toothbrush 114 attaches and taper down to no height before the end of the guide tube 120 at pedestal 112. These ribs 190–195 cause the opening 182 to tend to center and limit the lateral range of motion of the guide tube 120 more when the pop-out toothbrush 100 is in the retracted position of FIG. 12 than in the extended position of FIG. 17. Thus, ribs 186, 188 mutually complement ribs 190–195 in their guiding function.

In general, while the pop-out toothbrush 100 is in the retracted position of FIGS. 6 and 12, moving the guide tube 120 further into housing 110 causes the cover portions 134*a*, 134*b* to open, causes the toothbrush 114 to extend out of the housing 110, and causes the cover portions to close on the end 117 of the toothbrush handle 116. In the reverse manner, while the pop-out toothbrush 100 is in the extended position of FIGS. 7 and 17, moving the guide tube 120 back out of housing 110 causes the cover portions 134*a*, 134*b* to open, causes the toothbrush 114 to retract back into the housing 110, and causes the cover portions 134*a*, 134*b* to close. This action is generally caused by the interaction between control surfaces associated with the guide tube and control arms operatively connected to the cover portions.

Figure 9:
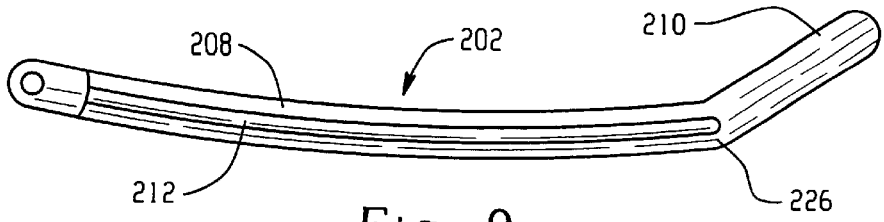
Figure 10:
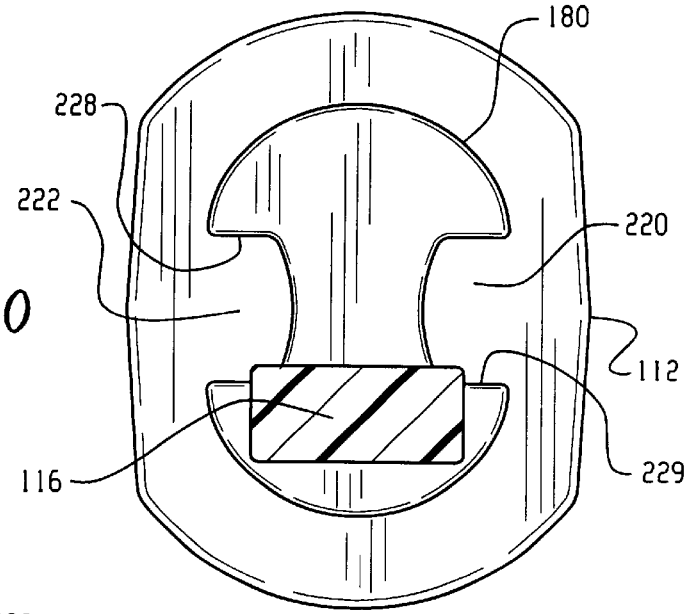

More specifically with reference to FIGS. 8 and 12–17, upper cover 134*a* has operatively associated therewith a control lever 200 and lower cover 134*b* has operatively associated therewith a control lever 202. The control lever 202 specific to this implementation is shown in FIG. 9. In the specific implementation in the figures, the control levers 200, 202 are preferably pivotally connected to projections 204, 206 extending from supports 139 and 146 on the cover portions 134*a*, 134*b*. Control levers 200, 202 preferably have the general shape of a hockey stick, having a longer portion 208 and a shorter portion 210 at an angle to the longer portion 208. The longer portion of both control levers 200, 202 preferably has a strengthening rib 212 extending substantially its whole length on both sides thereof. The shorter portion preferably does not have any such strengthening rib. The projections 204, 206 and the control levers 200, 202 are preferably positioned in the cavity 118 inside the housing 110.

The control levers 200, 202 preferably operatively interact with the guide tube 120 to open and close the cover portions. More specifically to the figures, and with specific reference to FIG. 10, the stop 180 integral with guide tube 120 has two openings 220, 222, one on each side thereof. The control levers 200, 202 are positioned within the openings 222, 220, respectively and contact portions of the stop that define the openings 220, 222, as discussed below. Referring now to FIG. 12, the pop-out toothbrush is in the retracted position with the guide tube 120 and stop 180 being fully retracted. The front edge 229 of opening 220 may or may not engage the shorter portion 210 of control lever 202. Similarly, the front edge 228 of opening 222 may or may not engage the shorter portion 210 of control lever 200. In either event, these edges 228, 229 of stop 180 engage their respective control arms either initially or after moving the guide tube 120 a short way into the housing 110. With respect to the motion of the guide tube 120 into the housing 110, very shortly after the edges 228, 229 of stop 180 engage their respective control arms, the shorter portion 210 of the control arms becomes bound to the stop by the interaction (e.g., frictional engagement) of the control lever with the various surfaces of engagement (e.g., surfaces of the stop 180 that form the openings 220, 222, the internal wall of the housing 110, etc.). Thus, after this point, further movement of the guide tube 120 into the housing is transferred to the cover portions 134*a*, 134*b* via control levers 200, 202 causing them to open after only a very slight movement of the guide tube 120 into the housing 110. The cover portions 134*a*, 134*b*, in the specific implementation the jaws of the animal, essentially pop open with very little movement of the guide tube 120 into the housing 110. This is preferable, because the bristle head 124 of the toothbrush 114 is integral with the guide tube 120 and any movement of the guide tube into the housing 110 also causes a movement of the bristle end 124 further out of the housing 110. In units made in accordance with the preferred embodiment, there may exist some slight flexing and/or twisting of portions of the control levers as the guide tube 120 is initially moved with the control arms bound to the stop, e.g., (i) the shorter portion 210 twists inside the opening 220, 222 until it engages another surface of the stop and/or the housing 110 and/or (ii) the control lever flexes at the portion 226 of each control lever where the longer portion 208 meets the shorter portion 210, etc. The specific control levers 200, 202 of the specific implementation shown in the figures are essentially wrested through the openings 220, 222 and in the process pop open the cover portions 134*a*, 134*b*.

Figure 3:
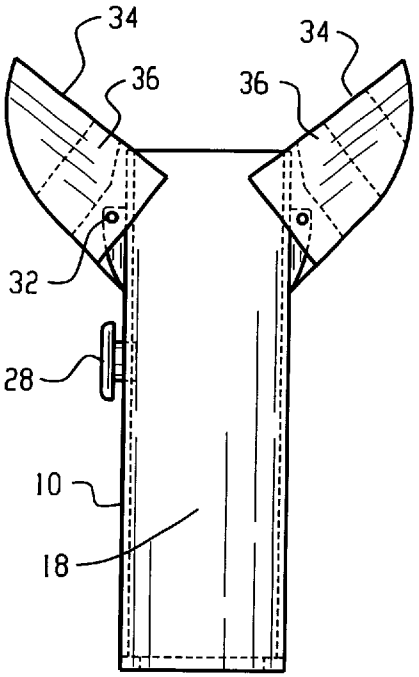
FIGS. 1–5 show a first embodiment of the present invention.
Figure 13:
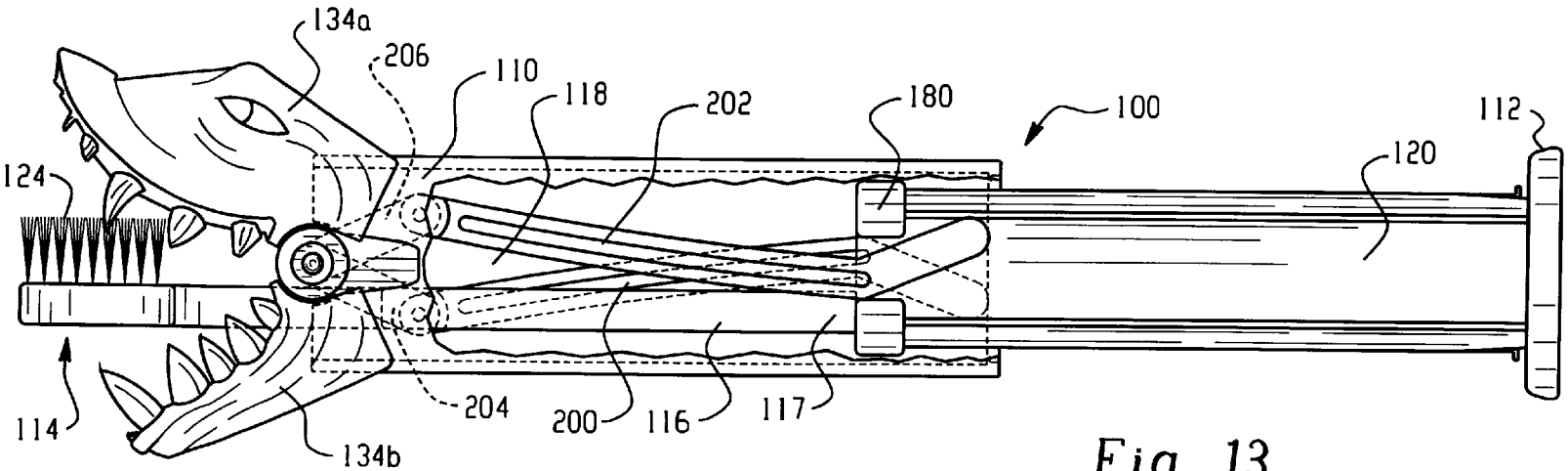
Figure 14:
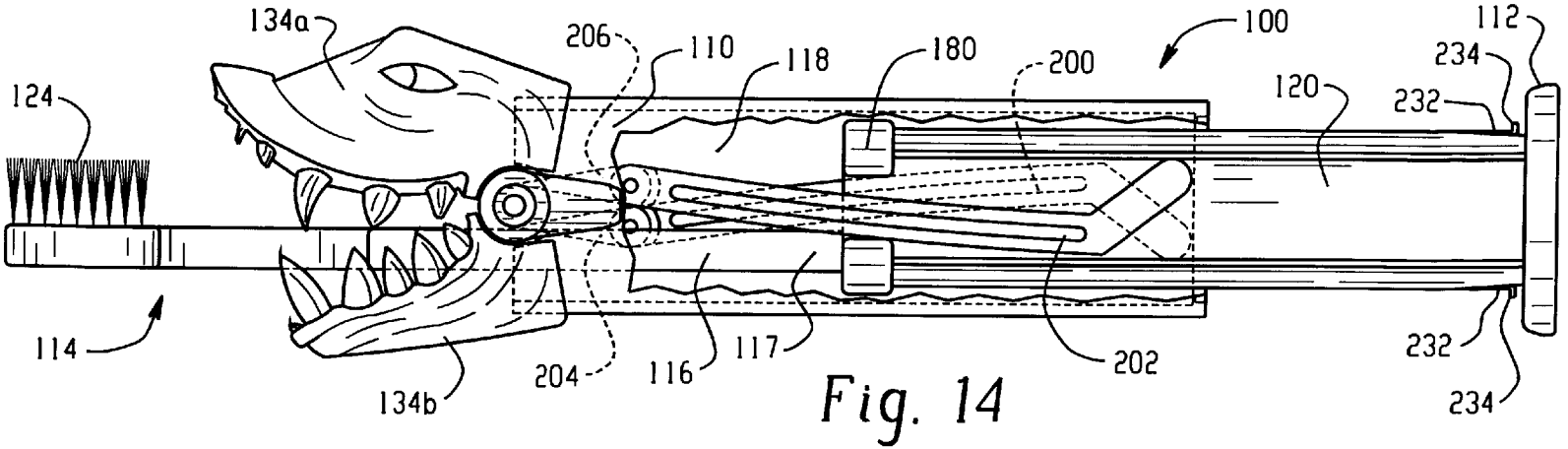

With continued pushing of the guide tube 120 into the housing 110, the control edges of the stop eventually clear the point 226 on the control levers 200, 202 as shown in FIG. 13. At this point, the cover portions 134*a*, 134*b* begin to slowly close on the handle 116. Further movement of the guide tube 120 into the housing 110 allows the springs 136*a*, 136*b* to continue to close the cover portions 134*a*, 134*b* as the bristle head 124 of toothbrush 114 further extends. This series is shown in FIGS. 13–15. At a point in the procedure at about FIG. 15 when the stop 180 is close to the pivot points 205, 207 for the control levers 200, 202, the cover portions 134*a*, 134*b* have closed on the handle 116 of the toothbrush 114, because of the force applied by the springs 136*a*, 136*b* has been permitted to close the cover portions by the control levers. Although not shown in the figures, the teeth directly above and below the handle 116 are preferably shorter to allow the covers 134*a*, 134*b* to close substantially around the handle 116. In the alternative, if other cover portions are used, e.g., the plain, symmetrical clam shell covers 34 shown in FIGS. 3 and 5 are used, then an opening is preferably provided in one or more cover portions to allow the cover portions to substantially close on the handle 116 without there being significant gaps between the cover portions. At the point in the process shown in FIG. 16, the projections 204, 206 and not the control levers 200, 202 are within the openings 220, 222. There is not much resistance to movement of the guide tube 120 back and forth between FIGS. 13–16. There is a much higher resistance to movement of the guide tube back and forth between FIGS. 12 and 13.

In addition, the second embodiment has a locking mechanism to prevent the toothbrush 114 from being pushed back into the housing 110 during brushing. This locking mechanism preferably comprises a flexible tab that engages the housing. Referring now to FIGS. 8, 11, 16 and 17, the housing 110 has an opening 230 creating a flexible tab 232 having a locking projection 234 that engages an internal portion of end cap 182 of housing 110. In FIG. 16, the locking projection 234 is about to be engaged. In FIG. 17, the locking projection has engaged the internal portion of end cap 182 of housing 110. The locking force provided by the tab and projection need only be sufficient to prevent the toothbrush 114 from being pushed back into the housing 110 during brushing and should be able to be overcome by a typical user.

The pop-out toothbrush 100 is moved from the extended position to the retracted position in reverse order of FIGS. 12–17 (FIGS. 17, 16, 15, 14, 13, and 12 in that order). In moving the pop-out toothbrush 100 from FIG. 17 to FIG. 16, the user unlocks the housing from the guide tube by pulling on the pedestal 112 in a direction to remove it back out of the housing 110, which flexes the flexible tab 232 and disengages the locking projection 234. As the user continues to pull on the pedestal, the cover portions 134*a*, 134*b* slowly cam open as portions of the stop 180 interact with the control arms 200, 202, and the toothbrush 114 and bristle head 124 are retracted, as shown in the sequence of figures from FIG. 16 to FIG. 15 to FIG. 14 to FIG. 13. At about the point shown in FIG. 13, the resistance to movement of the guide tube greatly increases as the shorter portion 210 of the control arms 200, 202 begin to bind with the portions (control edges/surfaces) of the stop 180 forming the openings 220, 222. Continued movement of the guide tube 120 pulls the control levers 200, 202 causing the cover portions 134*a*, 134*b* to close, preferably pop closed, on the bristle head 124 as the position of FIG. 12 is assumed. In moving back from FIG. 13 to FIG. 12, the specific control levers 200, 202 of the specific implementation shown in the figures are essentially wrested through the openings 220, 222 and in the process permit the force applied by springs 136*a*, 136*b* to close the cover portions 134*a*, 134*b*. Note that in the specific implementation in the figures, essentially a parody of a shark, the bristle head 124 is substantially covered, but not completely enclosed or covered. As shown in FIG. 6, portions of the bristle head 124 are seen between the teeth. Additionally, there is a gap (not shown) between the front teeth (so the covers 134*a*, 134*b* can close on the brush handle 116) through which portions of the bristle head 124 can be seen. Thus, it is not necessary that the bristle head 124 be completely enclosed for an embodiment to have utility. The specific implementation shown protects the bristle head from contacting various surfaces and medium-sized objects, even though smaller objects might be poked through the gaps in the cover portions. In this regard, cover portions having numerous openings, or constructed out of rigid or partially rigid mesh might also suffice.

All the components of the second embodiment 100 (except the bristles, the pin 138 and the springs 136*a*, 136*b*) may be formed, e.g., injection molded, using one or more of many suitable materials such as acrylonitrile butadiene styrene (ABS), having appropriate hygienic properties for use as a toothbrush. The housing 110 and end cap 182 are preferably injection molded in one piece, but may be separately injection molded and assembled in any suitable fashion, e.g., with adhesive. The guide tube 120 and pedestal 112 are preferably injection molded in one piece, but may be separately injection molded and assembled in any suitable fashion, e.g., with adhesive. Each of the cover portions 134*a*, 134*b* and their respective planar supports 139, 140 and 146, 148, and their respective projections 204, 206 are preferably injection molded in one piece, but may be separately injection molded and assembled in any suitable fashion, e.g., with adhesive. The stop 180 is preferably injection molded in one piece and secured to the guide tube 120 in any suitable fashion, e.g., with adhesive. The pin 138 is preferably made of metal, e.g., stainless steel, and the end caps 166, 168 are preferably injection molded. The control levers 200, 202 are preferably injection molded as one piece each. They are pivotally secured to their respective projections 204, 206 by passing a pin 240, 242 on each through their respective holes 205, 207 in their respective projections 204, 206, then using heat-deformation to deform each pin 240, 242 (without adhering or welding it to the projection) to create a flare (not shown in the figures) that holds each control arm pivotally in place, as known to those skilled in the art, thereby forming cover assemblies (with respective cover portions 134*a*, 134*b*, projections 204, 206, supports 139, 140, 146, 148, and control levers 200, 202). The toothbrush 114 including the bristle head 124 is fabricated using methods known to those skilled in the art and is preferably affixed to the stop 180 with adhesive. The springs 136*a*, 136*b* are preferably stainless steel stock springs. Virtually any ornamental expression can be used to decorate the various pieces of the pop-out toothbrushes according to the present invention, e.g., (i) forming the covers 134*a*, 134*b* from differently shaped pieces, (ii) painting or coloring parts of the covers 134*a*, 134*b* and/or (iii) applying a label to the outside surface of the housing 110.

In assembling the pop-out toothbrush 100, the stop end of the guide tube/pedestal piece (without the stop) is fully inserted into the opening 184 and the stop/toothbrush piece is secured to the guide tube with adhesive. Then the cover portions are placed in their assembled positions, with each control lever 200, 202 being threaded down through its respective opening, 220, 222. Then the springs 136*a*, 136*b* are positioned, and the pin 138 is inserted into the series of holes described above and the end caps 166, 168 are secured, as described above.

The use of the pop-out toothbrush 100 is very straightforward as seen by reference to FIGS. 6 and 7. While the pop-out toothbrush 100 is in the retracted position of FIG. 6, the user can move the toothbrush 114 to the extracted or extended position of FIG. 7 by grasping the housing 110 with one hand and pushing the pedestal 112 so that the guide tube is slowly forced into the housing 110. As described above, the cover portions 134*a*, 134*b* will open, the toothbrush will extend, and the cover portions 134*a*, 134*b* will close again. The pedestal 112 is pushed until the locking projection 234 is engaged as in FIG. 7. While the pop-out toothbrush 100 is in the extracted or extended position of FIG. 7, it may be used to brush one's teeth or the teeth of another in the ordinary way and/or as instructed by a dental care professional. While the pop-out toothbrush 100 is in the extended position of FIG. 7, the user can move the toothbrush 114 to the retracted position of FIG. 6 by grasping the housing 110 with one hand and pulling the pedestal 112 so that the guide tube 120 is slowly withdrawn from the housing 110. In response thereto, the locking projection 234 will disengage, the cover portions 134*a*, 134*b* will open, the toothbrush will retract, and the cover portions 134*a*, 134*b* will close again.

While the present invention has been illustrated by the description of embodiments thereof, and while the embodiments have been described in some detail, it is not the intention of the applicant to restrict or in any way limit the scope of the appended claims to such detail. Additional advantages, implementations, and modifications will readily appear to those skilled in the art. For example, the control levers 200, 202 might be integral with the cover portions (either manufactured integrally therewith or affixed thereto), rather than being hinged thereto. As another example, integral control levers 200, 202 might be made of various thicknesses, with some portions being rigid and some portions flexing and other portions providing a hinge. As yet another example, the control levers 200, 202 might be made in a totally different configuration and not at all similar to a hockey stick. As still another example, the second embodiment can be modified so that the cover portions remain opened during brushing. As yet another example, the control levers can be modified to cause the cover portions to pop open and then pop closed after the bristle head has extended. As another example, the second embodiment can be modified so that only one of the covers, e.g., the top cover, opens and closes after the bristle head exits, and the lower cover can be, but need not be, rigidly affixed to the housing. Therefore, the invention in its broader aspects is not limited to the specific details, representative apparatus and method, and illustrative examples shown and described. Accordingly, departures may be made from such details without departing from the spirit or scope of the applicant's general inventive concept.

We claim:

1. A toothbrush and an enclosure therefore comprising:

a housing having a plurality of cover portions at a top end thereof, at least one of said cover portions being movable between open and closed positions and being biased into their respective closed positions;

the toothbrush having a toothbrush handle and a bristle head at one end thereof, said toothbrush handle movable within said housing between (a) a retracted position in which said toothbrush handle and said bristle head are substantially enclosed by said housing and said cover portions and (b) an extended position in which said bristle head is uncovered and displaced a sufficient distance from said housing and said cover portions to permit said bristle head to be inserted into a mouth of a user gripping said housing and used by the user to brush the user's teeth;

said covet portions operatively interacting with said toothbrush handle such that, responsive to said toothbrush handle being moved from the retracted position toward the extended position, said cover portions are moved to their respective open positions to permit said bristle head to extend toward said extended position; and said cover portions operatively interacting with said toothbrush handle such that, subsequent to said cover portions moving to their respective open positions and responsive to said toothbrush handle being moved further toward the extended position, said cover portions are moved toward their respective closed positions.

2. The toothbrush and enclosure therefore according to claim 1 further comprising a releasable lock to keep said toothbrush handle and said bristle head in said extended position during brushing.

3. The toothbrush and enclosure therefore according to claim 1, wherein said cover portions operatively interact with said toothbrush handle such that, subsequent to said cover portions moving to their respective open positions and responsive to said toothbrush handle being moved further toward the extended position, said cover portions are moved to their respective closed positions, thereby closing said cover portions about said toothbrush handle in said extended position.

4. The toothbrush and enclosure therefore according to claim 1, wherein said cover portions are moved to their respective open positions responsive to a relatively small amount of initial movement of said toothbrush handle from the refracted position toward the extended position.

5. The toothbrush and enclosure therefore according to claim 1, further comprising a guide affixed to said toothbrush handle, said guide extending through said housing to allow movement of said toothbrush handle between said retracted and extended positions.

6. The toothbrush and enclosure therefore according to claim 1, further comprising a guide tube affixed to an end of said toothbrush handle opposite the bristle head, said guide tube extending generally parallel to said toothbrush handle and extending through said housing to allow movement of said toothbrush handle between said retracted and extended positions.

7. The toothbrush and enclosure therefore according to claim 1, said cover portions being further characterized by providing an opening while in their respective closed positions, permitting said cover portions to close about said toothbrush handle in said extended position, so that said closed position for said cover portions with said toothbrush handle in said extended position is substantially the same as said closed position for said cover portions with said toothbrush handle in said retracted position.

8. A toothbrush and an enclosure therefore comprising:

a housing having a plurality of cover portions at a top end thereof, at least one of said cover portions being movable between open and closed positions and being biased into their respective closed positions, the toothbrush having a toothbrush handle and a bristle head at one end thereof, said toothbrush handle movable within said housing between (a) a refracted position in which said toothbrush handle and said bristle head are substantially enclosed by said housing and said cover portions and (b) an extended position in which said bristle head is uncovered and displaced a sufficient distance from said housing and said cover portions to permit said bristle head to be inserted into a mouth of a user gripping said housing and used by the user to brush the user's teeth;

said cover portions having at least one control arm extending therefrom, said at least one control arm extending into said housing a substantial way into said housing;

said toothbrush handle having operatively associated therewith at least one control surface, said at least one control surface engaging said at least one control arm during at least a portion of travel of said toothbrush handle between said retracted position and said extended position; and said at least one control arm and said control surface being characterized such that, responsive to said toothbrush handle being moved from the retracted position toward the extended position, said at least one control arm interacts with said at least one control surface causing said cover portions to move to their respective open positions.

9. The toothbrush and enclosure therefore according to claim 8 further comprising a releasable lock to keep said toothbrush handle and said bristle head in said extended position during brushing.

10. The toothbrush and enclosure therefore according to claim 8, wherein said cover portions are moved to their respective open positions responsive to a relatively small amount of initial movement of said toothbrush handle from the retracted position toward the extended position.

11. The toothbrush and enclosure therefore according to claim 8, wherein said at least one control arm and said control surface are further characterized such that, subsequent to said cover portions moving to their respective open positions and responsive to said toothbrush handle being moved further toward the extended position, said at least one control arm interacting with said at least one control surface causes said cover portions to move to their respective closed positions, thereby closing said cover portions about said toothbrush handle in said extended position.

12. The toothbrush and enclosure therefore according to claim 8, further comprising a guide affixed to said toothbrush handle, said guide extending through said housing to allow movement of said toothbrush handle between said retracted and extended positions.

13. The toothbrush and enclosure therefore according to claim 8, further comprising a guide tube affixed to an end of said toothbrush handle opposite the bristle head, said guide tube extending generally parallel to said toothbrush handle and extending through said housing to allow movement of said toothbrush handle between said refracted and extended positions.

14. The toothbrush and enclosure therefore according to claim 8, said cover portions being further characterized by providing an opening while in their respective closed positions, permitting said cover portions to close about said toothbrush handle in said extended position, so that said closed position for said cover portions with said toothbrush handle in said extended position is substantially the same as said closed position for said cover portions with said toothbrush handle in said retracted position.

15. The toothbrush and enclosure therefore according to claim 8, each of said control arms being further characterized by having a longer portion that extends generally along the length of said housing inside said housing and a shorter portion positioned at an angle to the longer portion, and each of said longer portions being pivotally connected to their respective cover portions.

16. A toothbrush and an enclosure therefore comprising:

a housing having a plurality of cover portions at a top end thereof, at least one of said cover portions being movable between open and closed positions and being biased into their respective closed positions;

the toothbrush having a toothbrush handle and a bristle head at one end thereof, said toothbrush handle movable within said housing between (a) a retracted position in which said toothbrush handle and said bristle head are substantially enclosed by said housing and said cover portions and (b) an extended position in which said bristle head is uncovered and displaced a sufficient distance from said housing and said cover portions to permit said bristle head to be inserted into a mouth of a user gripping said housing and used by the user to brush the user's teeth;

said cover portions having at least one control arm extending therefrom;

said toothbrush handle having associated therewith at least one control surface corresponding to each of said at least one control arms;

said at least one control arm of said cover portions interacting with said at least one control surface of said toothbrush handle such that, responsive to said toothbrush handle being initially moved from the retracted position toward the extended position, said cover portions are moved to their respective open positions to permit said bristle head to extend toward said extended position; and said at least one control arm of said cover portions interacting with said at least one control surface of said toothbrush handle such that, subsequent to said cover portions moving to their respective open positions and responsive to said toothbrush handle being moved further toward the extended position, said cover portions are moved toward their respective closed positions.

17. The toothbrush and enclosure therefore according to claim 16 further comprising a releasable lock to keep said toothbrush handle and said bristle head in said extended position during brushing.

18. The toothbrush and enclosure therefore according to claim 16, wherein said at least one control arm of said cover portions interact with said at least one control surface of said toothbrush handle such that, subsequent to said cover portions moving to their respective open positions and responsive to said toothbrush handle being moved further toward the extended position, said cover portions are moved to respective closed positions, thereby closing said cover portions about said toothbrush handle in said extended position.

19. The toothbrush and enclosure therefore according to claim 16, wherein said cover portions are moved to their respective open positions responsive to a relatively small amount of initial movement of said toothbrush handle from the retracted position toward the extended position.

20. The toothbrush and enclosure therefore according to claim 19, wherein said cover portions are moved to their respective closed positions responsive to a relatively small amount of movement of said toothbrush handle toward the extended position after said bristle head extends past said cover portions.

21. The toothbrush and enclosure therefore according to claim 16, wherein said cover portions are moved to their respective closed positions responsive to a relatively small amount of movement of said toothbrush handle toward the extended position after said bristle head extends past said cover portions.

22. The toothbrush and enclosure therefore according to claim 16, further comprising a guide affixed to said toothbrush handle, said guide extending through said housing to allow movement of said toothbrush handle between said refracted and extended positions.

23. The toothbrush and enclosure therefore according to claim 16, further comprising a guide tube affixed to an end of said toothbrush handle opposite the bristle head, said guide tube extending generally parallel to said toothbrush handle and extending through said housing to allow movement of said toothbrush handle between said retracted and extended positions.

24. The toothbrush and enclosure therefore according to claim 16, said cover portions being further characterized by providing an opening while in their respective closed positions, permitting said cover portions to close about said toothbrush handle in said extended position, so that said closed position for said cover portions with said toothbrush handle in said extended position is substantially the same as said closed position for said cover portions with said toothbrush handle in said refracted position.

25. The toothbrush and enclosure therefore according to claim 16, each of said control arms being further characterized by having a longer portion that extends generally along the length of said housing inside said housing and a shorter portion positioned at an angle to the longer portion, and each of said longer portions being pivotally connected to their respective cover portions.

26. A toothbrush and an enclosure therefore comprising:

a housing having a plurality of cover portions at a top end thereof, said cover portions being movable between open and closed positions and being spring biased into their respective closed positions;

the toothbrush having a toothbrush handle, said toothbrush handle having a bristle head at one end thereof and a guide tube at another end thereof, said guide tube extending generally parallel to said toothbrush handle;

said toothbrush handle movable within said housing between (a) a retracted position in which said toothbrush handle and said bristle head are substantially enclosed by said housing and said cover portions, and a substantial portion of said guide tube extends out of said housing, and (b) an extended position in which said bristle head is uncovered and displaced a sufficient distance from said housing and said cover portions to permit said bristle head to be inserted into a mouth of a user gripping said housing and used by the user to brush the user's teeth, and a substantial portion of said guide tube extends into said housing;

each of said cover portions having at least one control arm extending therefrom and pivotally connected thereto, said control arms extending into said housing a substantial way into said housing, each of said control arms characterized by having a longer portion that extends generally along the length of said housing inside said housing and a shorter portion positioned at an angle to the longer portion, and each of said longer portions pivotally connected to their respective cover portions;

said cover portions further characterized by providing an opening while in their respective closed positions, permitting said cover portions to close about said toothbrush handle in said extended position, so that said closed position for said cover portions with said toothbrush handle in said extended position is substantially the same as said closed position for said cover portions with said toothbrush handle in said retracted position;

said guide tube having affixed thereto a stop at an end of said guide tube adjacent said toothbrush handle, said stop defining at least one control slot for each of said control arms, with each of said control slots engaging their respective control anus during at least a portion of travel of said toothbrush handle between said retracted position and said extended position;

said guide tube further comprising a releasable lock to keep said toothbrush handle and said bristle head in said extended position during brushing;

said control arms and said control slots characterized such that, responsive to said toothbrush handle being initially moved from the retracted position toward the extended position, said shorter portions of said control arms interact with their respective control slots to cause said cover portions to move to their respective open positions with a relatively small amount of movement of said toothbrush handle to permit said bristle head to extend toward said extended position; and said control arms and said control slots further characterized such that, subsequent to said cover portions moving to their respective open positions and responsive to said toothbrush handle being moved further toward the extended position, said longer portions of said control arms interact with their respective control slots to allow said cover portions to move to their respective closed positions, thereby closing said cover portions about said toothbrush handle in said extended position;

said control arms and said control slots further characterized such that, responsive to said toothbrush handle being moved from the extended position toward the retracted position, said longer portions of said control arms interact with their respective control slots to cause said cover portions to move to their respective open positions to permit said bristle head to move toward said retracted position; and said control arms and said control slots further characterized such that, subsequent to said cover portions moving to their respective open positions and responsive to said toothbrush handle being moved further toward the retracted position, said shorter portions of said control arms interact with their respective control slots to allow said cover portions to move to their respective closed positions with a relatively small amount of movement of said toothbrush handle toward said retracted position, thereby closing said cover portions about said toothbrush handle in said retracted position.

27. The toothbrush and enclosure therefore according to claim 26, each of said control arms being further characterized by having a longer portion that extends generally along the length of said housing inside said housing and a shorter portion positioned at an angle to the longer portion, and each of said longer portions being pivotally connected to their respective cover portions.

28. A toothbrush and an enclosure therefore comprising:

a housing with doors at a top end thereof pivotable between open and closed positions and a pedestal at the bottom end thereof so as to permit said housing to stand upright;

a toothbrush with a handle and bristle head secured to one distal end thereof, said handle slidably engaging interior walls of said housing between refracted position in which said handle and said bristle head are fully enclosed within said housing and an extended position in which said bristle head is fully uncovered and displaced a sufficient distance to permit said bristle head to be inserted into a mouth of and manipulated by a user gripping said housing, said doors biased into the closed position and being opened by abutment of said bristle head when being moved into said extended position;

a first element connected to said bandle for moving said handle between said retracted and extended positions;

a second element for releasably locking said handle to said housing when moved into said extended position; and a third element positioned within said housing for abutting the other distal end of said handle when said toothbrush is in the retracted position thereby preventing further movement of said handle.

29. A toothbrush and an enclosure therefore comprising:

a housing having a plurality of cover portions at a top end thereof, at least one of said cover portions being movable between open and closed positions;

means for biasing said cover portions into their respective closed positions;

the toothbrush having a handle and a bristle head at one end thereof, said handle movable within said housing between (a) a retracted position in which said handle and said bristle head are substantially enclosed by said housing and said cover portions and (b) an extended position in which said bristle head is uncovered and displaced a sufficient distance from said housing and said cover portions to permit said bristle head to be inserted into a mouth of a user gripping said housing and used by the user to brush the user's teeth;

means for moving said cover portions into their respective open positions;

means for moving said cover portions into their respective closed positions;

means for moving said handle from said retracted position to said extended position; and means for moving said handle from said extended position to said retracted position.

30. The toothbrush and enclosure therefore according to claim 29 further comprising means for releasably locking said handle and said bristle head in said extended position during brushing.

31. A toothbrush and an enclosure therefore comprising:

a housing having a plurality of cover portions at a top end thereof, at least one of said cover portions being movable between open and closed positions and being biased into their respective closed positions;

the toothbrush having a toothbrush handle and a bristle head at one end thereof, said toothbrush handle movable within said housing between (a) a retracted position in which said toothbrush handle and said bristle head are substantially enclosed by said housing and said cover portions and (b) an extended position in which said bristle head is uncovered and displaced a sufficient distance from said housing and said cover portions to permit said bristle head to be inserted into a mouth of a user gripping said housing and used byte user to brush the user's teeth;

said cover portions operatively interacting with said toothbrush handle such that, responsive to said toothbrush handle being moved from the retracted position toward the extended position, said cover portions are moved to their respective open positions to permit said bristle head to extend toward said extended position.

32. The toothbrush and enclosure therefore according to claim 31, further comprising a releasable lock to keep said toothbrush handle and said bristle head in said extended position during brushing.

33. The toothbrush and enclosure therefore according to claim 31, wherein said cover portions operatively interact with said toothbrush handle such that, subsequent to said cover portions moving to their respective open positions and responsive to said toothbrush handle being moved further toward the extended position, said cover portions are moved to their respective closed positions, thereby closing said cover portions about said toothbrush handle in said extended position.

34. The toothbrush and enclosure therefore according to claim 31, wherein said cover portions are moved to their respective open positions responsive to a relatively small amount of initial movement of said toothbrush handle from the retracted position toward the extended position.

35. The toothbrush and enclosure therefore according to claim 31, further comprising a guide affixed to said toothbrush handle, said guide extending through said housing to allow movement of said toothbrush handle between said retracted and extended positions.

36. The toothbrush and enclosure therefore according to claim 31, further comprising a guide tube affixed to an end of said toothbrush handle opposite the bristle head, said guide tube extending generally parallel to said toothbrush handle and extending through said housing to allow movement of said toothbrush handle between said retracted and extended positions.

* * * * *

UNITED STATES PATENT AND TRADEMARK OFFICE

CERTIFICATE OF CORRECTION

PATENT NO. : 6,671,920 B2
DATED : January 6, 2004
INVENTOR(S) : Jay C. Pearlman and Douglas R. Russell It is certified that error appears in the above-identified patent and that said Letters Patent is hereby corrected as shown below:

Column 1,
Line 7, please delete “TITERFOR;” and insert -- THEREFORE --.

Column 9,
Line 40, please delete “covet” and insert -- cover --.

Column 10,
Lines 3 and 32, please delete “refracted” and insert -- retracted --.

Column 11,
Line 21, please delete “refracted” and insert -- retracted --.

Column 12,
Lines 44 and 60, please delete “refracted” and insert -- retracted --.

Column 13,
Line 44, please delete “anus” and insert -- arms --.

Column 14,
Line 34, please delete “refracted” and insert -- retracted --.
Line 44, please delete “bandle” and insert -- handle --.

Column 15,
Line 30, please delete “byte” and insert -- by the --.

Signed and Sealed this

Twenty-seventh Day of April, 2004

JON W. DUDAS
*Acting Director of the United States Patent and Trademark Office*